US006732375B2

(12) United States Patent
Nornes

(10) Patent No.: US 6,732,375 B2
(45) Date of Patent: May 11, 2004

(54) INFANT BIB

(76) Inventor: Loyd Arve Nornes, Berglund 15, N-4280 Skudeneshavn (NO)

( * ) Notice: Subject to any disclaimer, the term of this patent is extended or adjusted under 35 U.S.C. 154(b) by 0 days.

(21) Appl. No.: 10/203,065

(22) PCT Filed: Jan. 30, 2001

(86) PCT No.: PCT/NO01/00032

§ 371 (c)(1),
(2), (4) Date: Mar. 25, 2003

(87) PCT Pub. No.: WO01/56412

PCT Pub. Date: Aug. 9, 2001

(65) Prior Publication Data

US 2003/0159191 A1 Aug. 28, 2003

(30) Foreign Application Priority Data

Feb. 2, 2000 (NO) ..... 20000546

(51) Int. Cl.[7] ..... A41B 13/10
(52) U.S. Cl. ..... 2/49.1; 12/49.4
(58) Field of Search ..... 2/49.1, 49.2, 49.3, 2/49.4, 49.5, 46, 48, 50, 51, 52, 102, 111, 468, 463, 174, 206, 207, 144, 146, 145, 104; 606/234, 235, 236; 446/28, 27, 227; 248/102

(56) References Cited

U.S. PATENT DOCUMENTS

| | | | | | |
|---|---|---|---|---|---|
| 2,569,915 | A | * | 10/1951 | Arseneault | 2/49.3 |
| 2,631,288 | A | | 3/1953 | Daust | |
| 2,653,324 | A | * | 9/1953 | McMahon | 2/49.2 |
| 2,769,980 | A | * | 11/1956 | Fleischer | 2/174 |
| 2,796,208 | A | * | 6/1957 | O'Leary et al. | 2/102 |
| 3,064,267 | A | * | 11/1962 | Tullos | 2/174 |
| 3,289,986 | A | * | 12/1966 | Martin | 248/103 |
| 3,429,138 | A | * | 2/1969 | Goldmerstein | 62/259.3 |
| 4,114,199 | A | * | 9/1978 | Malan | 2/49.3 |
| 4,473,907 | A | | 10/1984 | Maillard | |
| 4,604,758 | A | | 8/1986 | Grasberger et al. | |
| 4,694,510 | A | | 9/1987 | Kamrath | |
| 4,697,589 | A | * | 10/1987 | King et al. | 606/234 |
| 4,719,650 | A | | 1/1988 | Milloy | |
| 4,862,518 | A | | 9/1989 | Williams et al. | |
| 4,969,894 | A | * | 11/1990 | Hempstead-Harris | 606/234 |
| 5,062,558 | A | * | 11/1991 | Stang | 224/270 |
| 5,312,282 | A | | 5/1994 | Cooper | |
| 5,318,590 | A | * | 6/1994 | Brennan et al. | 606/234 |
| 5,490,289 | A | | 2/1996 | Lehrer | |
| 5,666,665 | A | | 9/1997 | Morgado | |
| 5,898,940 | A | | 5/1999 | Cameron | |
| 6,055,667 | A | | 5/2000 | Jimenez | |
| 6,442,759 | B1 | * | 9/2002 | Straham et al. | 2/49.1 |

FOREIGN PATENT DOCUMENTS

| | | |
|---|---|---|
| DE | 299 02 842 U1 | 11/1999 |
| DE | 299 02 842 U 1 | 11/1999 |
| EP | 0 524 325 A1 | 1/1993 |
| GB | 1 371 189 | 4/1973 |
| GB | 1 371 189 | 10/1974 |
| JP | 63270801 | 11/1988 |

* cited by examiner

*Primary Examiner*—A. Vanatta
(74) *Attorney, Agent, or Firm*—Knobbe, Martens, Olson & Bear, LLP

(57) ABSTRACT

A child's bib for use concurrent with a pacifier so as to inhibit the pacifier from falling out of the child's mouth or to retain the pacifier adjacent the child's head. The bib can include a case of flexible material, such as cloth, and an inelastically deformable material encased within the case such that the bib may be deformed to form a stop structure to retain the pacifier or to catch the pacifier should it fall out. The bib can also include a bib element including an inelastically deformable material that is attachable to a surface of a conventional bib, such as via hook-and-loop tape. The bib can also be deformed to form a catch structure to catch material, such as food, that may exit the child's mouth.

10 Claims, 4 Drawing Sheets

INFANT BIB

RELATED APPLICATIONS

This application is a national phase application of PCT/NO01/00032 filed Jan. 30, 2001 and claims the benefit of the Norwegian application No. 20000546 filed Feb.2. 2000.

BACKGROUND OF THE INVENTION

1. Field of the Invention

This invention relates to an infant bib and/or a bib for small children who use pacifiers, but who are normally unable to put their pacifiers back into their mouths if the pacifiers should fall out.

2. Description of the Related Art

A bib of the kind that the present invention concerns itself with, is the conventional bib, which by and large takes the form of a piece of cloth or plastic for protecting clothes against dribble and food spillage. Such bibs are provided with fastening means, for example in the form of two fastening bands, one at either one of the upper corners of the rectangular bib, which can be tied together or connected in any easily releasable manner.

Infants wear bibs when they eat, but since some infants and otherwise very small children often throw up food at night-time, the use of a bib has also been normal after the child has been put to bed to sleep.

In order to support a pacifier in its position of use in an infant's mouth, so that it does not fall out so easily, one can try to crumple and shape the bib so that it might have a certain supporting effect to begin with, but experience tells that each time the child turns its head, the bib is brought out of its supporting position, which is thereby neutralised, whereby the bib can no longer prevent the pacifier from falling out.

A child who loses its pacifier, will usually wake up and make some sounds. Thereby the parents may be disturbed repeatedly every night.

U.S. Pat. No. 5,666,665 discloses an additional element in a flat bib for infants. Said element has the form of a roll of liquid-/milk-absorbing cloth and is attached to the upper edge of the bib, at that point were excess milk may presumably run down when the child is fed milk from a feeding bottle.

U.S. Pat. Nos. 5,312,282 and 4,473,907 disclose bibs, to which feeding bottles can be attached and thus be held in position by the bibs, so that the child can suck the teat of the bottle. These combined teats and feeding bottles are best suited for older infants and are not known in combination with pacifier.

Replaceable front pieces on bibs are known in themselves, cf. U.S. Pat. No. 5,490,289, in which hook-and-loop tapes are used as connecting means. Here, attachable outer front pieces with great absorption properties are discussed. An inner front piece, whose upper portion is covered by the attachable/replaceable front piece, has a lower, upward open, non-covered pocket, meant to receive scraps of food and similar which are not caught through absorption by the outer absorbing front piece.

U.S. Pat. No. 4,694,510 and European patent application, publication No. 0 524 325 A1, show bibs equipped in other ways.

None of the bibs explained briefly above have inherent properties to facilitate maintenance of a bent shape with the purpose of supporting and holding a pacifier in place in the mouth for a child who cannot manage to get a pacifier that has fallen out of its mouth, back into its mouth, even if it is in the immediate vicinity of the child's head and hands.

SUMMARY OF THE INVENTION

Thus it has been an object of the invention to provide a bib including soft surfaces of layers of cloth and provided with fastening means, which has properties that make it well suited for being bent and shaped so that it provides efficient and lasting support of a pacifier in a child's mouth, so that the pacifier is inhibited from falling inadvertently out of the child's mouth. By the expression "lasting support" is meant that the bib maintains its pacifier-supporting bent shape in the conditions which can normally be expected for the bib.

According to one aspect of the invention this object is realised in that the bib can be at least partially plastically deformed.

According to the invention the bib is plastically deformable and will thus maintain its bent pacifier-supporting shape.

Based on easily available materials, such as aluminium foil, to provide the bib with the desirable plastic deformability, a multi-layer insert element of plastically deformable foil is wrapped in an external case of soft, flexible, sheet-like cloth or plastic material, for example two layers of cotton fabric which are sewn together along abutting circumferential rim portions to enclose, between themselves, a multi-layer insert element of metal foil.

The bib, which is manufactured in this way, may be equipped with fastening means, for example the two conventional ribbons attached to two of the bib's corners. In addition to the circumferential seams the bib may be provided, if desirable or necessary, with longitudinal and/or transversal seams in order better to keep the layers of the foil insert in place inside the cotton case.

In a manner known in itself, this basic bib may possibly have hook-and-loop tape sewn on for the attachment of an ordinary bib over the front portion of the basic bib.

Due to the plastic deformability of the insert, a bib constructed according to this invention can be bent and shaped so that it obtains an elevated support edge, against which the external part of the pacifier, that is the stop disc that bears on the external portions of the child's lips, and possibly a ring attached to the stop disc, will bear in a supporting manner and thus be inhibited from falling out of the child's mouth, even when the child falls asleep and does not at all times exert the suction force which is necessary to keep the pacifier in place in its mouth. As mentioned above, this concerns infants or very young children who will not at all be able to get the pacifiers back into place if they have fallen out of their mouths.

BRIEF DESCRIPTION OF THE DRAWINGS

A non-limiting example of a possible embodiment will be explained in the following with reference to the appended schematic drawings, in which.

DETAILED DESCRIPTION OF THE PREFERRED EMBODIMENT

Figure 1:
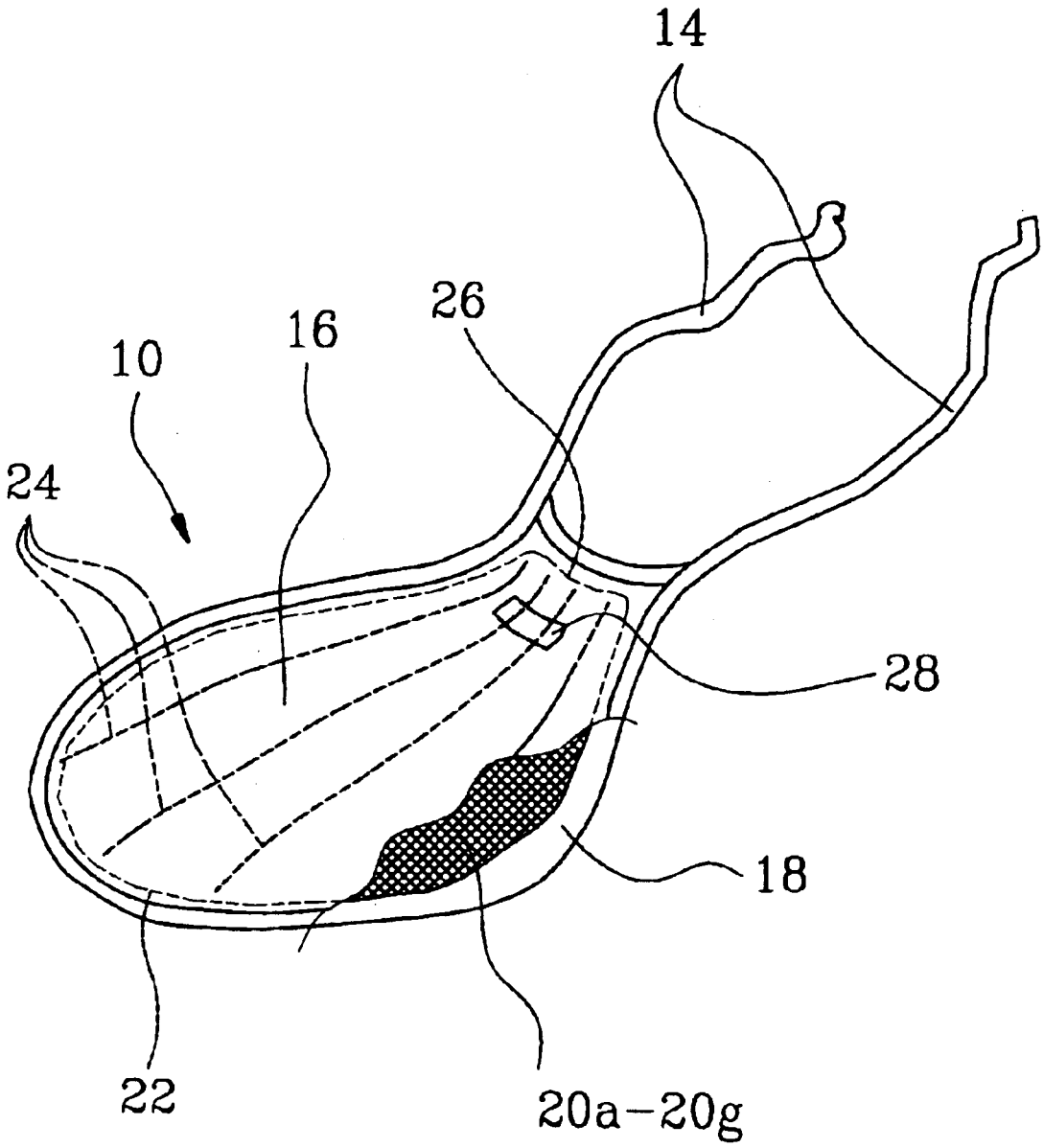
FIG. 1 shows a bib, for example in the form of a so-called basic bib (for the attachment of a bib front piece thereto) in a random illustrative perspective, in which one lower corner portion of the upper cotton layer of an outer case has been cut away, so that an insert of layers of aluminium foil is exposed.

In the figures of the drawings reference numeral 10 generally identifies a bib according to embodiments of the invention.

Figure 2:
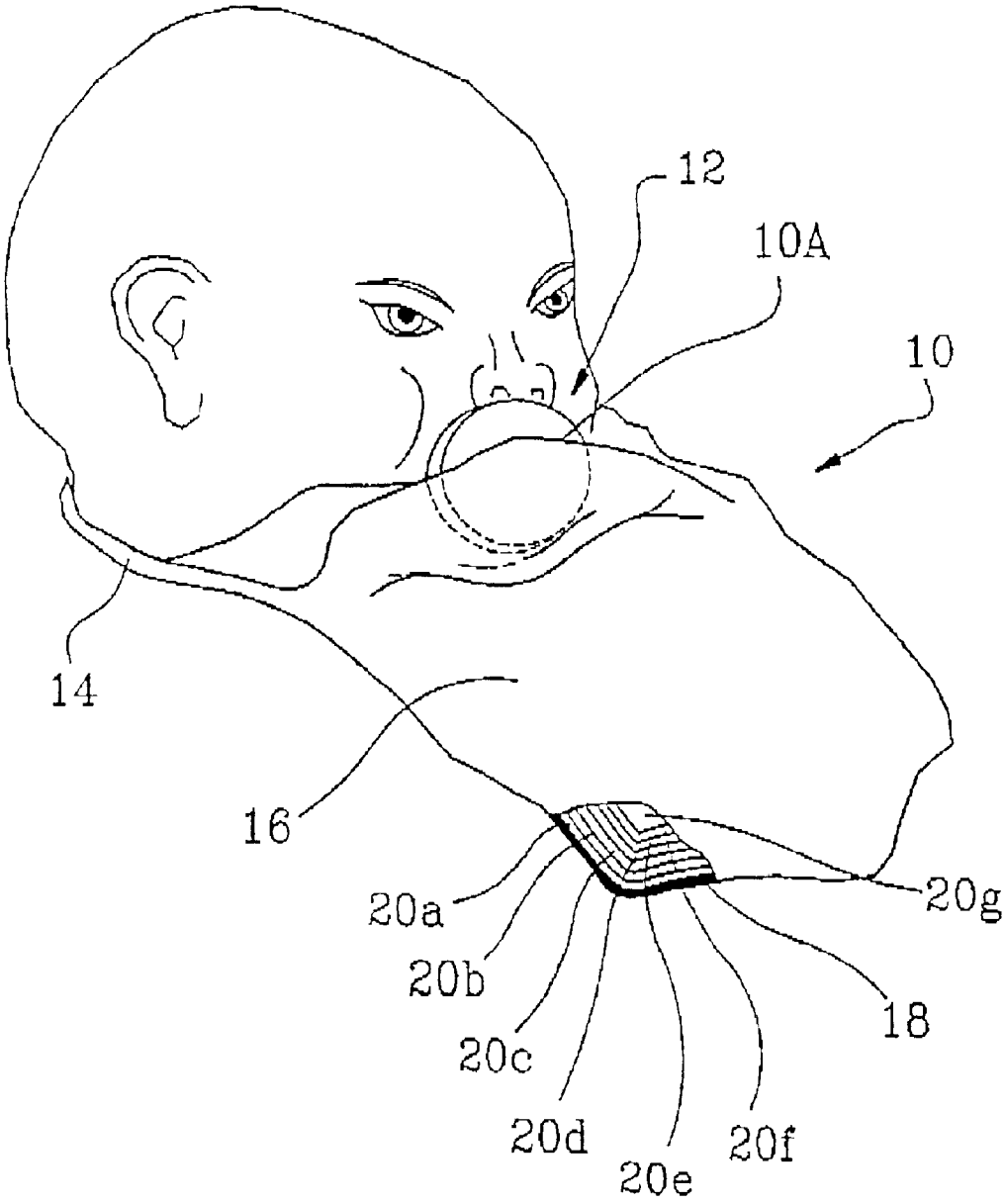
FIG. 2 shows in a perspective view a similar bib in use, in which can be seen, in a cut-away corner of the outer case, several layers of aluminium foil lying on top of each other, which are also cut slightly in the visible corner to visualise the above-lying layers of foil.
Figure 3:
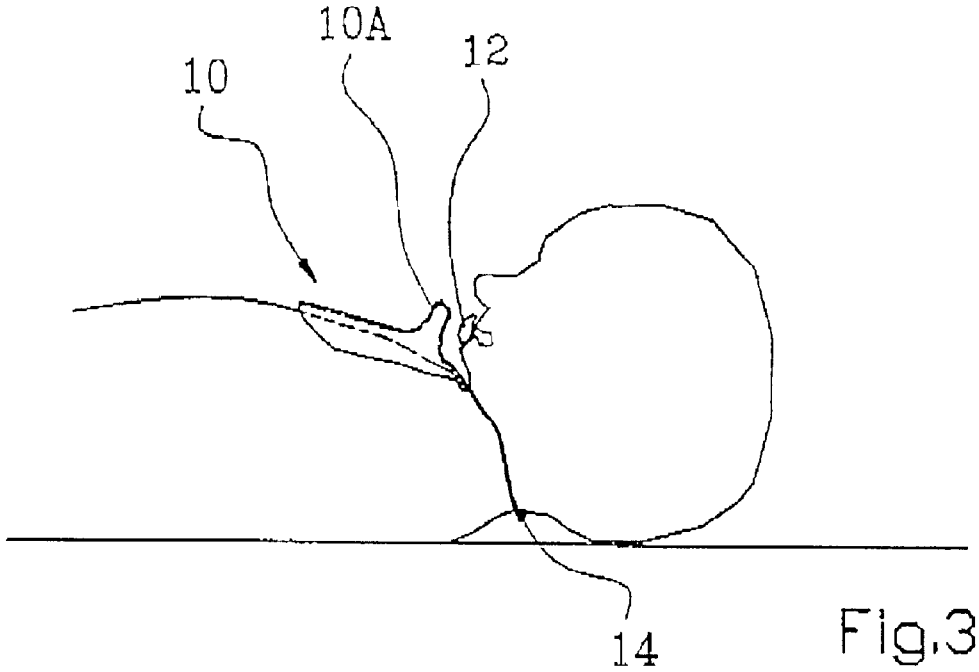
FIGS. 3–5 show, in schematic side views, bibs in positions of use, in which a bib portion has been bent for the purpose of attaining a specific effect and function, FIGS. 3 and 4 showing a bib bent in an upper portion in a manner corresponding to that in FIG. 2, FIG. 5 showing a bending of lower bib portion in a manner to improve the capacity of the bib to collect crumbs and other scraps from the child's meal.
Figure 4:
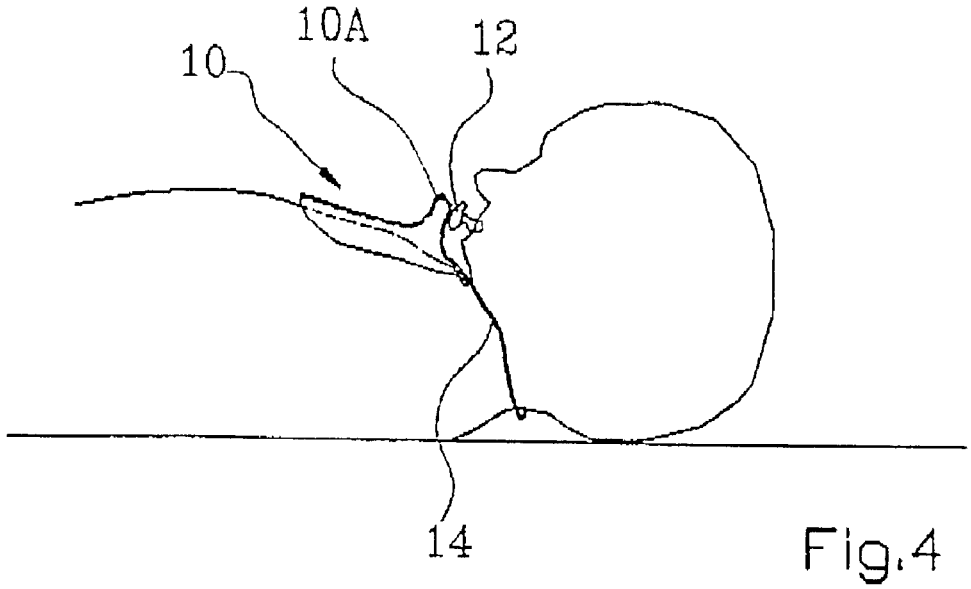

In FIGS. 2–4 reference numeral 12 identifies a pacifier, which is in use and is represented here by the stop disc, which bears in its position of use against the child's lips and prevents the nipple-like sucking-element of the pacifier from being swallowed. Such a pacifier is often provided with a ring which is secured centrally on the stop disc.

The bib 10 is provided with ordinary fastening ribbons 14, whose free end portions are tied together at the child's neck, or are connected to one another in another manner, for example by means of hook-and-loop tape.

In this embodiment, the bib 10 comprises an outer case consisting of an upper layer 16 and a lower layer 18 which form a protective apron portion of the bib. Between the layers 16, 18, which may include cotton fabric or other soft flexible cloth or plastic material, are inserted a plurality, in this specific embodiment seven, parallel aluminium foils 20*a*, 20*b*, 20*c*, 20*d*, 20*e*, 20*f*, 2*g*, which are shown cut, in FIG. 2, in the lower corner portion of the bib, which has been exposed by removal of the upper layer of cotton fabric of the bib case 10.

After the insert 20*a*–20*g* has been positioned between them, the upper and lower layers 16 and 18 of the bib case are sewn together along the circumferential edges, or connected in another manner, for example by welding, fusing etc. if the case comprises weldable plastic.

Seams along the rims are identified by 22 in FIG. 1. Intermediate longitudinal/transversal seams 24/26 may be provided.

In order to maintain an intended bent bib shape, the plastic deformability of the aluminium foil insert 20*a*–20*g* is utilised, the soft cotton layers of the bib case following the bending and shaping of the foil 20*a*–20*g* due to their flexibility.

In FIGS. 2–4 of the drawings the bib 10 has been bent and shaped at an upper portion to have an elevated supporting portion in order to keep the pacifier 12 in place, so that it will not inadvertently fall out, cf. FIG. 4 in particular. This supporting portion, which the stop disc of the pacifier 12 will be forced against when it is about to fall out of the child's mouth, and whereby it is inhibited from doing so, is defined upwards by an upper rim 10A.

Said pacifier-supporting portion of the bib is immediately opposite the external part 12 of the pacifier and is in its way when the pacifier is about to fall out of the child's mouth, FIG. 4. Should the pacifier still fall out, the shaped supporting portion immediately below the raised edge 10A could in most cases catch the pacifier before it moves away from the immediate vicinity of the child's head.

The front piece (cotton layer 16) of the bib 10 may be provided with a securing mechanism comprising hook-and-loop tapes 28 for attachment to the child's ordinary bib or for the attachment of one out of a number of different bib front pieces (not shown). The case layer 16 which comes to be the uppermost one in use, may possibly be provided with decorations that are common on bibs.

Of course, it is possible that such an attachable bib front piece carries the fastening ribbons 14 or other fastening means, so that such may possibly be left out in the basic bib. In this case, the basic bib is preferably provided with hook-and-loop tapes or other fastening means for connection to the bib front piece.

Figure 5:
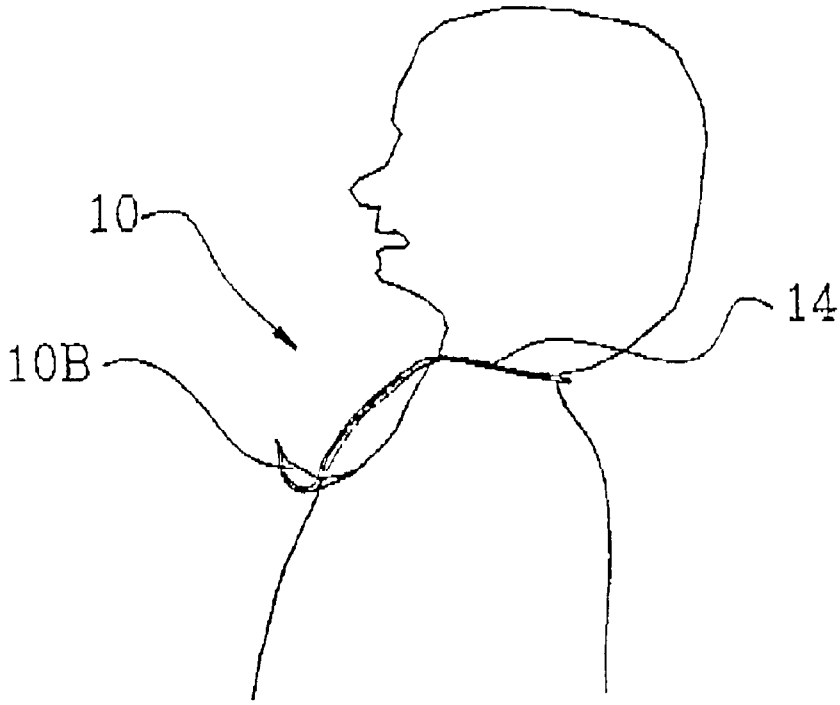

FIG. 5 shows an additional function of a plastically deformable bendable bib 10 according to the invention. In its position of use, the lower free portion of a bib 10 is here bent upwards for the formation of a kind of collecting groove 10B for crumbs and other scraps from the child's meal.

What is claimed is:

1. A child's bib comprising:

an outer closed flat case formed of an upper and a lower layer of cloth, joined along overlapping circumferential portions;

an inelastically deformable multi-layer foil insert positioned within the flat case and extending adjacent a user's mouth and arranged to be shaped to retain a pacifier in the mouth of the user; and fastening means for the attachment of the bib to at least one of round a child's neck and to another bib element carrying corresponding fastening means.

2. The bib of claim 1, wherein the insert comprises a plurality of generally identical aluminium foils placed on top of each other, whose outer edges are kept positionally fixed inside the case.

3. A child's bib comprising:

a multi-layer apron insert of inelastically deformable material;

opposed surface layers of flexible material joined together so as to substantially enclose the multi-layer inelastically deformable material; and an attachment arrangement adapted to secure the bib about a child's neck such that the bib may be inelastically deformed to provide a barrier to facilitate retention of objects in the child's mouth.

4. The bib of claim 3, wherein the layer of inelastically deformable material comprises a plurality of individual sheets of inelastically deformable material.

5. The bib of claim 4, wherein the individual sheets comprise a metallic foil.

6. The bib of claim 3, wherein the attachment arrangement comprises ribbons adapted to be tied around the child's neck.

7. The bib of claim 3, wherein the bib may be inelastically deformed to provide a catch structure to facilitate retention of material that may exit the child's mouth.

8. A bib element for attachment to at least one surface of a bib, the bib element comprising:

a multi-layer apron element of inelastically deformable material; and a securing mechanism attached to at least one surface of the multi-layer element such that the securing mechanism and the multi-layer element can be attached to at least one surface of the bib such that the bib may be inelastically deformed so as to form stop structures to retain objects in a user's mouth.

9. The bib element of claim 8, wherein the attachment of the bib element to the bib is a releasable attachment.

10. The bib element of claim 8, wherein the securing mechanism comprises hook-and-loop tape.

* * * * *